United States Patent [19]

Whorton et al.

[11] Patent Number: 4,902,252

[45] Date of Patent: Feb. 20, 1990

[54] HIGH VOLTAGE ELECTRICAL CONNECTOR

[75] Inventors: Jere D. Whorton; Carl O. Gellenthin, Jr., both of Houston, Tex.

[73] Assignee: Signeon Corporation, Houston, Tex.

[21] Appl. No.: 339,026

[22] Filed: Apr. 17, 1989

Related U.S. Application Data

[63] Continuation-in-part of Ser. No. 265,029, Oct. 31, 1988.

[51] Int. Cl.[4] ..... H01R 11/09

[52] U.S. Cl. ..... 439/796; 439/723; 439/750; 439/786; 439/790

[58] Field of Search ..... 439/723-725, 439/738, 739, 750, 751, 780, 786, 787, 790, 796, 879, 880, 930, 598, 278, 279, 904

[56] References Cited

U.S. PATENT DOCUMENTS

| | | | |
|---|---|---|---|
| 3,009,986 | 11/1961 | Stephens | 439/750 |
| 3,206,717 | 9/1965 | Brown et al. | 439/723 |
| 3,522,576 | 8/1970 | Cairns | 439/796 |
| 3,705,256 | 12/1972 | Eftestol et al. | 439/880 |
| 4,070,087 | 1/1978 | Dumesril | 439/724 |
| 4,614,399 | 9/1986 | Gemra et al. | 439/904 |

FOREIGN PATENT DOCUMENTS

| | | | |
|---|---|---|---|
| 1066790 | 11/1979 | Canada | 439/796 |
| 2636461 | 3/1977 | Fed. Rep. of Germany | 439/790 |

*Primary Examiner*—P. Austin Bradley

*Attorney, Agent, or Firm*—Fulbright & Jaworski

[57] ABSTRACT

A high voltage electrical connector for quickly connecting two stripped back electrical conductors including a plastic enclosure, a tubular glass insulator in the enclosure, a metal liner in the glass insulator, and first and second metal connectors telescopically positioned inside of the liner. Each of the connectors includes a longitudinal opening in the middle, and a longitudinal channel on the outside for receiving a bent back stripped electrical conductor. The liner includes first and second inwardly biased electrical contacts engaging the conductors in the longitudinal channels. Rotational alignment between the connectors and the liner align the biased electrical contacts with the longitudinal channels.

5 Claims, 2 Drawing Sheets

HIGH VOLTAGE ELECTRICAL CONNECTOR

CROSS-REFERENCES TO RELATED APPLICATIONS

This application is a continuation-in-part to co-pending application Serial No. 07/265,029, filed Oct. 31, 1988, entitled Snap-In High Voltage/Low Current Electrical Connector.

BACKGROUND OF THE INVENTION

The present invention is directed to an electrical connector, and in particular to an electrical connector for connecting two electrical conductors together for use in high voltage, low current applications such as used in the neon sign industry.

Commercial neon signs, such as a channel letter sign, require an approved connection for the 6,000 to 15,000 volt, 20 to 120 milliamp circuits. However, because of the lack of a product which meets the criteria of city and state electrical codes and approval of testing laboratories, it has been necessary to provide an uninterrupted continuity of conductors from one neon sign unit to the next.

The present invention is directed to the high voltage electrical connector which can quickly and easily connect two electrical conductors together and provide the necessary criteria to meet electrical codes. The present invention allows the connection to be made after the end of the electrical conductors are stripped of insulation leaving a bare end, by hand, without tools, in a few seconds, by persons with no special skills. In addition, while the present conductor is self-locking, it can be disconnected and reused.

Summary

The present invention is directed to a high voltage electrical connector for connecting two electrical conductors together and includes a plastic enclosure for providing a protective covering, and a tubular glass insulator positioned inside of the enclosure for providing high voltage protection. A tubular electrical conductive metal liner is positioned in the glass insulator and the liner includes first and second inwardly biased electrical contacts. First and second metal connectors are positioned inside of the liner and each of the connectors includes an opening in the inside and a longitudinal channel on the outside which are adapted to receive the bare ends of an electrical conductor. The channels of the first and second connectors coact with the first and second biased electrical contacts, respectively, for providing an electrical connection between the electrical conductors.

Still a further object of the present invention is wherein the metal connectors and the metal liner are longitudinally movable relative to each other, but include engaging means between the connectors and the liner preventing rotation therebetween. This allows the channels of the connectors holding the bare conductors to align with and direct the biased electrical contacts into engagement with the electrical conductors. In addition, the biased electrical contacts are sized to be biased into their coacting longitudinal channel.

Yet a further object of the present invention is wherein a high voltage electrical connector is provided for quickly and manually connecting two stripped back electrical conductors together without tools. A plastic enclosure around a tubular glass insulator provides the necessary high voltage insulation and protection. A tubular metal liner is nonrotatably positioned in the glass insulator and includes first and second inwardly biased electrical contacts. First and second metal connectors are telescopically positioned inside of the metal liner. Each of the connectors includes a longitudinal opening the middle and a longitudinal channel on the outside. The opening and channel of each connector are adapted to receive a bent back stripped conductor for holding the conductor as it is installed in the liner. The channels of the first and second connectors are wider than and coact with the first and second biased electrical contacts, respectively, to provide an electrical connection between the electrical conductors. Engaging means between the connectors and the liner require rotational alignment therebetween for properly aligning the biased contacts and channels as the connectors are inserted into the liner.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
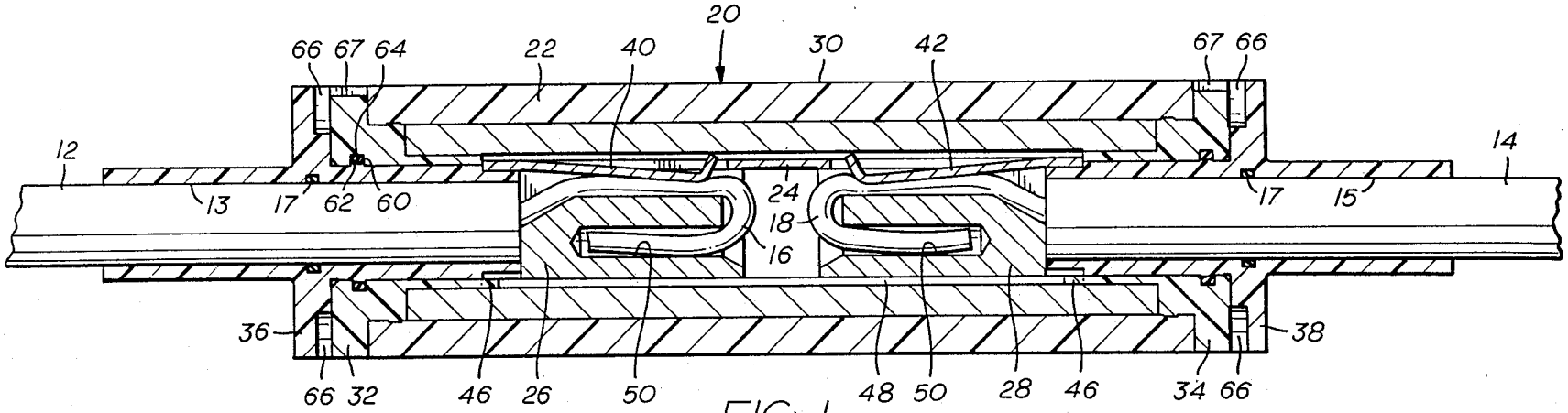
FIG. 1 is an elevational view, in cross section, illustrating the connector of the present invention connecting two electrical conductors.
Figure 2:
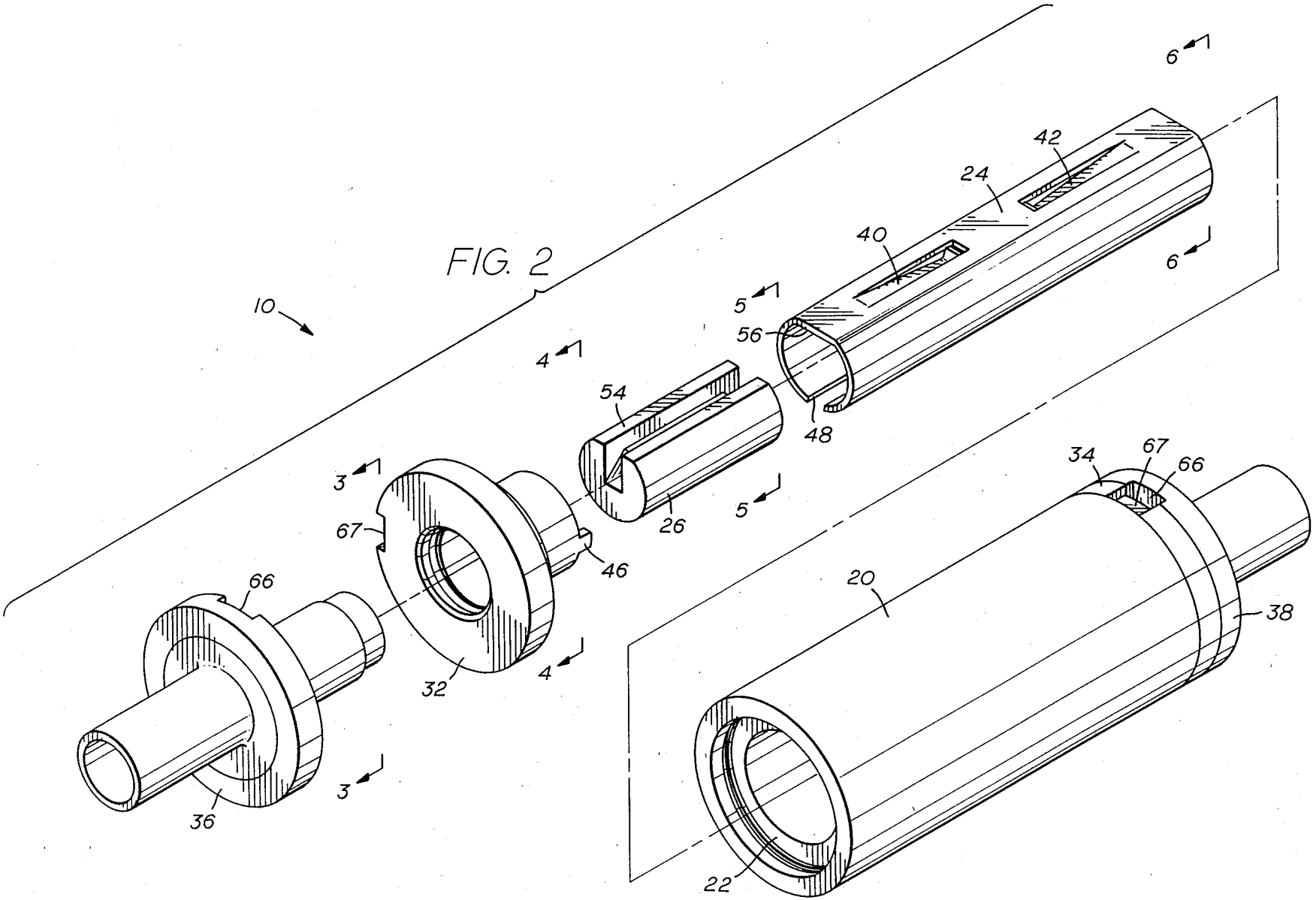
FIG. 2 is an exploded perspective view illustrating the various components of FIG. 1.

Referring now to the drawings, and particularly to FIGS. 1 and 2, the reference numeral 10 generally indicates the high voltage electrical connector of the present invention for connecting two electrical conductors 12 and 14 together. The conductors 12 and 14 may be of any suitable type and size, for example, No. 18 AWG. The present connector 10 allows the connection between the conductors 12 and 14 to be made manually and without any tools after the conductors 12 and 14 have been stripped back to provide bare ends 16 and 18, respectively.

The connector 10 generally includes a plastic enclosure 20, a tubular glass insulator 22, a metal liner 24, and first 26 and second 28 metal connectors.

The plastic enclosure 20 includes a tubular body member 30, mirror image end caps 32 and 34, and mirror image end receptacles 36 and 38. While the body 20 and its components 30, 32, 34, 36 and 38 may be of any suitable type of plastic, the plastic should be of a suitable type to protect the glass insulator 22 as well as be a suitable insulator and flame retardant. For example, a suitable material such as that sold under the trademark "LEXAN" is satisfactory. The glass insulator 22 will house and enclose the electrical connection and will provide the necessary insulation to withstand the high voltage connections found in neon signs, such as 6000–15000 volts and 20–120 milliamp currents. While any suitable glass or ceramic material having the required dielectric properties may be used, the glass product sold under the trademark —PYREX– by Corning is satisfactory.

Figure 6:
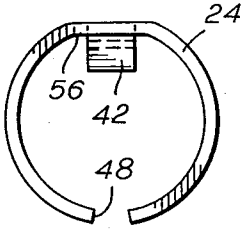
FIG. 6 is a cross-sectional view taken along the line 6—6 of FIG. 2.

The tubular electrically conductive metal liner 24, as best seen in FIGS. 1, 2 and 6, includes a first 40 and a second 42 inwardly biased electrical contact. A non-rotatable connection is provided between the enclosure 20 and the metal liner 24. For example, end caps 32 and 34 may each include a tab 46 (end cap 32 in FIG. 2 is shown rotated 90° for illustrating the tab 46). The tabs 46 coact with a groove 48 in the liner 24 for preventing rotation of the liner 24 when the end receptacles 36 and 38 and connectors 26 and 28 are installed. Preferably, the outer tub 30, the glass insulator 22, and the end caps 32 and 34 are initially assembled with the liner 24 by a suitable bonding agent such as epoxy. The liner 24 may be of any suitable conductive metal material such as tempered beryllium copper.

Figure 5:
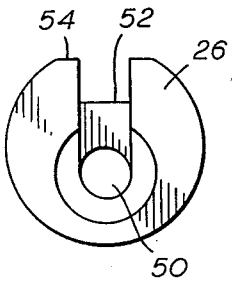
FIG. 5 is a cross-sectional view taken along the line 5—5 of FIG. 2.
Figure 4:
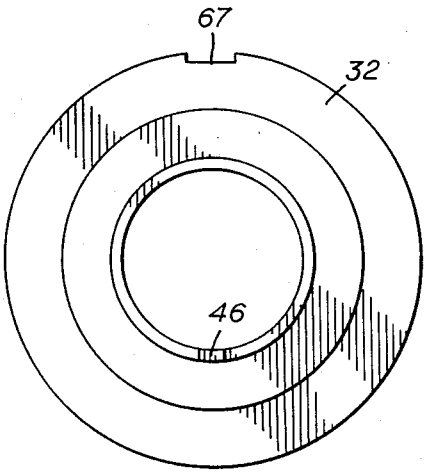
FIG. 4 is a cross-sectional view taken along the line 4—4 of FIG. 2.
Figure 3:
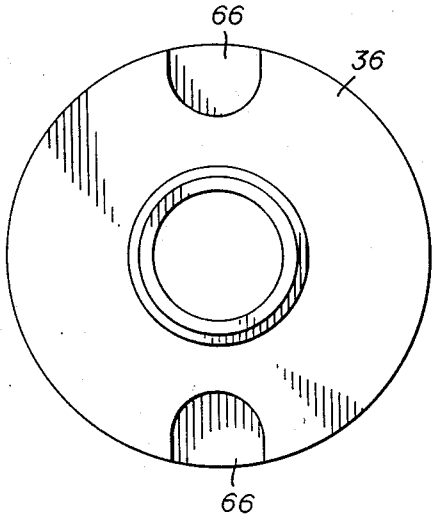
FIG. 3 is a cross-sectional view taken along the line 3—3 of FIG. 2.

Referring now to FIGS. 1, 2, and 5, the first and second metal connectors 26 and 28 are shown. Each of them includes a longitudinal opening 50 in the interior and a longitudinal channel 52 on the exterior. The openings 50 and 52 are provided to receive a stripped conductor end 16 or 18 which, when bent back will remain in place as the conductors 26 and 28 are telescopically inserted into the interior of the metal liner 24. As shown in FIG. 1, the stripped back ends of the conductors 16 and 18 lead into the channels 52 and are then bent back into the openings 50. However, if desired, the openings 50 could be entirely through the connectors 26 as disclosed in our co-pending parent application and in such case the bare end wires could extend first through the opening and then bent back into the channels.

It is also to be noted that there are engaging means between the connectors 26 and 28 and the metal liner 24 which prevent rotation therebetween. That is, each of the connectors 26 and 28 include a flat top 54 which coacts with a flat interior 56 in the liner 24. This requires that the connectors 26 and 28 be rotationally aligned with the liner 24 before they can be telescopically inserted therein. The channels 52 in the connectors 26 and 28 are sized slightly wider than the biased electrical contacts 40 and 42. Therefore, when the connectors 26 and 28 are rotationally aligned and telescopically inserted into the interior of the metal liner 24, the biased contacts 40 and 42 will align with the channels 52 and make contact with the bare ends 16 and 18, respectively, of the electrical conductors 12 and 14. Connectors 26 and 28 may be of any suitable conductive metal such as aluminum.

In operation, the metal liner 24 is inserted into the glass insulator 22 which in turn is inserted into the outer tubular enclosure 30 and the end caps 32 and 34 are inserted into position with their tabs 46 engaging and locking the metal liner 24 in position. The foregoing parts are preferably assembled and bonded together with a suitable adhesive.

Thereafter, the insulated conductors 12 and 14 are passed through the interiors 13 and 15 of the end receptacles 36 and 38, respectively, and the insulation is stripped off of the wires leaving the bare ends 16 and 18 exposed. It is to be noted that O-rings 17 in the end receptacles 36 and 38 seal off the exterior of the connector 10 from the interior.

The bare ends 16 and 18 of the conductors 12 and 14 are then passed over and into the channels 52 of the metal connectors 26 and 28, respectively, and are bent back and into the longitudinal openings 50. The connectors 26 and 28 are then telescopically inserted into the end caps 32 and 34, respectively, along with their end receptacles 36 and 38, respectively. It is to be noted that the length of the connectors 26 and 28 is preferably longer than the distance from the ends of the metal liner 24 to the end caps 32 so that the connectors 26 and 28 may be rotationally aligned manually for insertion into the liner 24. That is, with the coengaging surfaces 54 and 56 rotationally aligned, the biased contacts 40 and 42 will be aligned with the channels 52 and the connectors may be pushed into the liner 24 allowing the electrical contacts 40 and 42 to be biased inwardly into the channels 52 and engage the bare electrical wires 16 and 18, respectively.

The end receptacles 36 and 38 are longitudinally pressed into the end caps 32 and 34, respectively. Preferably, self-locking means are provided between each of the end caps 32 and 34 and its coacting end receptacles 36 and 38, respectively. For instance, a ridge 60 is provided on the exterior of each of the end receptacles 36 and 38 which engages into a recess 62 in the interior of its coacting end caps 32 and 34, respectively, in which there is an O-ring 64 sealing the connection. The connector 10 may be disengaged and reused at any time if desired. Openings 66 are provided between the end receptacles 36 and 38 and their end plates 32 and 34, respectively, for inserting a tool, such as a screwdriver, for retracting the end receptacles 36 and 38 and the interior connections.

The present invention provides for the quick and easy connection of high voltage/low current conductors, such as are needed in the neon sign industry. The present invention is efficient, economical, and meets the criteria of codes and testing authorities, that is, a glass enclosed connection. The connector 10 achieves a strong and positive connection between the conductors 12 and 14.

The entire connector is protected by a plastic outer enclosure 20.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A high voltage electrical connector for connecting two electrical conductors together comprising, a plastic enclosure for providing a protective covering, a tubular glass insulator positioned inside of the enclosure for providing high voltage protection, a tubular electrically conductive metal liner positioned in the glass insulator, said liner including first and second inwardly biased electrical contacts, first and second metal connectors positioned inside of the metal liner, said connectors each including an opening in the inside and a longitudinal channel on the outside, the opening and channel of each connector adapted to receive the bare end of an electrical conductor, and the channel of the first and second connectors coacting with the first and second biased electrical contacts, respectively, for providing an electrical connection between the electrical conductors.

2. The connector of claim 1 wherein said metal connectors and said metal liner are longitudinally movable relative to each other and including engaging means between said connectors and said metal liner preventing rotation therebetween.

3. The connector of claim 1 including, a non-rotatable connection between the enclosure and the metal liner.

4. The connector of claim 1 wherein said biased electrical contacts are sized to be biased into a coacting longitudinal channel.

5. A high voltage electrical connector for quickly connecting two stripped back electrical conductors together comprising, a plastic enclosure for providing a protective covering, a tubular glass insulator positioned inside the enclosure for providing high voltage protection, a tubular electrically conductive metal liner non-rotatably positioned in the glass insulator, said liner including first and second inwardly biased electrical contacts, first and second metal connectors telescopically positioned inside of the metal liner, each of the connectors including a longitudinal opening in the middle and a longitudinal channel on the outside, the opening and channel of each connector adapted to receive a bent back stripped conductor for holding the conductor, the channel of the first and second connectors being wider than and coacting with the first and second biased electrical contacts, respectively, for providing an electrical connection between the electrical conductors, and engaging means between said connectors and said metal liner requiring rotational alignment therebetween.

* * * * *